United States Patent [19]

Thalmann et al.

[11] Patent Number: 4,690,176

[45] Date of Patent: Sep. 1, 1987

[54] BACK REST ARRANGEMENT ON A WEAVING MACHINE

[75] Inventors: Theo Thalmann, St. Gallen, Switzerland; Gerhard Oesterle, Koblach, Austria

[73] Assignee: Aktiengesellschaft Adolph Saurer, Arbon, Switzerland

[21] Appl. No.: 828,040

[22] Filed: Feb. 10, 1986

[30] Foreign Application Priority Data

Feb. 14, 1985 [CH] Switzerland ..... 668/85

[51] Int. Cl.[4] ..... D03C 49/06

[52] U.S. Cl. ..... 139/110; 139/114

[58] Field of Search ..... 139/100, 105, 109, 110, 139/114, 115; 66/209, 210

[56] References Cited

U.S. PATENT DOCUMENTS

| | | | |
|---|---|---|---|
| 3,526,252 | 9/1970 | Hindle | 139/110 |
| 4,529,012 | 7/1985 | Sainen et al. | 139/110 |
| 4,554,951 | 11/1985 | Hirano et al. | 139/110 |

*Primary Examiner*—Henry S. Jaudon

*Attorney, Agent, or Firm*—Werner W. Kleeman

[57] ABSTRACT

In a back rest arrangement on a weaving machine the back rest is preferably carried at each of its ends by one arm of a two-armed support frame or yoke which is pivotable about a stationary pivot axis on a machine frame. At least one of the arms of the support frame or yoke possesses a resilient portion or shank. A free end of the resilient shank is supported in a manner which is relatively rigid in relation to a pivoting motion of the support frame or yoke caused by the varying warp force acting on the back rest. The resilient shank is in operative association with a sensing probe for generating an electrical signal which is proportional to the deflection of the resilient shank. These measures render the arrangement suitable both for a so-called rigid or fixed back rest support as well as for a back rest support utilizing a rocking lever or rocker beam. Consequently a simple, functionally reliable and accurate conception of a back rest arrangement can be achieved while still avoiding complex lever constructions and compensating rollers.

7 Claims, 5 Drawing Figures

BACK REST ARRANGEMENT ON A WEAVING MACHINE

CROSS REFERENCE TO RELATED APPLICATION

The present application is related to the commonly assigned, U.S. patent application Ser. No. 06/786,107, filed Oct. 10, 1985, and entitled "Apparatus for Controlling the Warp Thread Tension By Positional Displacement of a Back Rest on a Loom", now U.S. Pat. No. 4,607,666, granted Aug. 26, 1986, the disclosure of which is incorporated here-in by reference.

BACKGROUND OF THE INVENTION

The present invention broadly relates to a new and improved construction of a back rest arrangement on a weaving machine.

In its more particular aspects, the present invention relates to a new and improved construction of a back rest arrangement on a weaving machine whose back rest is supported in positionally variable or adjustable manner.

In modern weaving machines it is usual to regulate the rotary drive of the warp beam so as to generate a tension force on the warp thread sheets which is as constant as possible, for which purpose the tension of the warp thread being unwound or let off is employed as the control variable.

Correspondingly, the determination of the tension in the warp threads is effected near the warp beam in the region of the back rest which deflects the warp threads into a horizontal direction towards the weaving shed.

For example, in accordance with the German Patent Publication No. 3,406,888 the back rest is pivotably supported; through spring-loaded bell cranks or angle levers in the manner of a compensating roller and the free ends of the bell cranks or angle levers cooperate with a proximity switch which delivers an electrical signal which is proportional to the tension of the warp thread sheets.

As can, for instance, be seen from French Utility or Petty Patent No. 8,019,224, other embodiments are known which utilize additional compensating rollers.

All these known arrangements are relatively complicated. Furthermore they cannot be easily utilized in weaving machines where the back rest is supported by a so-called rocking lever or rocker beam. The back rest is supported at such rocker beam for the purpose of being able to adjust the position of the back rest, by suitable adjustment means, in addition to the positional change caused by the varying warp thread tension. Such adjustment is necessary in order to generate additional warp thread tension when starting operation of the weaving machine. This can be particularly well seen from German Patent No. 2,927,533.

SUMMARY OF THE INVENTION

Therefore, with the foregoing in mind, it is a primary object of the present invention to provide a new and improved construction of a back rest arrangement on a weaving shortcomings of the prior art constructions.

Another important object of the present invention is to devise a new and improved construction of a back rest arrangement with a positionally changeable or adjustable back rest that is suitable both for so-called rigid back rest supports as well as for back rest supports utilizing a rocking lever or rocker beam.

Yet another important object of the present invention is the provision of a simple, functionally reliable design of a back rest arrangement which avoids complicated lever constructions and compensating rollers and affords reliable determination and control of the warp tension.

Now in order to implement these and still further objects of the invention, which will become more readily apparent as the description proceeds, the back rest arrangement on a weaving machine of the present development is manifested by the features that the back rest is preferably carried at each of its ends by one arm of a two-armed supporting frame or yoke which is pivotable about a stationary pivot axis at the machine frame. At least one of the arms of the support frame possesses a resilient member or shank. A free end of the resilient member or shank is retained or supported in a manner which is relatively rigid in relation to the pivoting motion of the support frame or yoke caused by the varying warp force on the back rest. The resilient member or shank is in operative association with a sensing element or probe for generating an electrical signal which is proportional to the deflection of the resilient member or shank.

As can easily be seen, this arrangement results in a very simple but effective construction which permits using rigid back rest supports as well as supports which utilize rocking levers or rocker beams. This is achieved without having to fear any influence on the pivoting movement of the support frame or yoke which is caused by the changing or varying warp force at the back rest and therefore on the proportional deflection of the resilient member or shank.

This simple utilization of the inventive arrangement for rigid back rest supports as well as for back rest supports which utilize rocking levers rocker beams results when the relatively rigid support at the free end of the resilient member or shank is furthermore effected by a strut or connecting rod.

Consequently, for a rigid back rest support, the free end of the strut or connecting rod can be fixedly connected with the machine frame. For a back rest supported by a so-called passive rocking lever or rocker beam at the machine frame the free end of the strut or connecting rod can be supported at the machine frame by spring means and, additionally, for a back rest supported by a form-lockingly or positively controlled rocking lever or rocker beam at the machine frame, the free end of the strut or connecting rod can be in cooperative connection with a swivelling lever or rocking arm mechanism of the rocking lever or rocker beam.

In a first exemplary embodiment of the inventive back rest arrangement it is advantageous for the resilient member or shank to be formed by a substantially U-shaped configuration of the related arm of the pivotable frame or yoke, wherein the other member or shank confronting the resilient shank is stiff or rigid and, at its free end, carries the sensor intended for cooperation with the resilient shank. This sensor then may be a proximity probe of a capacitive or inductive type or is a Hall-effect sensor.

In a simplified construction, however, it is contemplated that the probe which is in cooperative contact with the resilient shank is an extensometer or strain gauge which directly samples or senses the deflection of the resilient shank.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
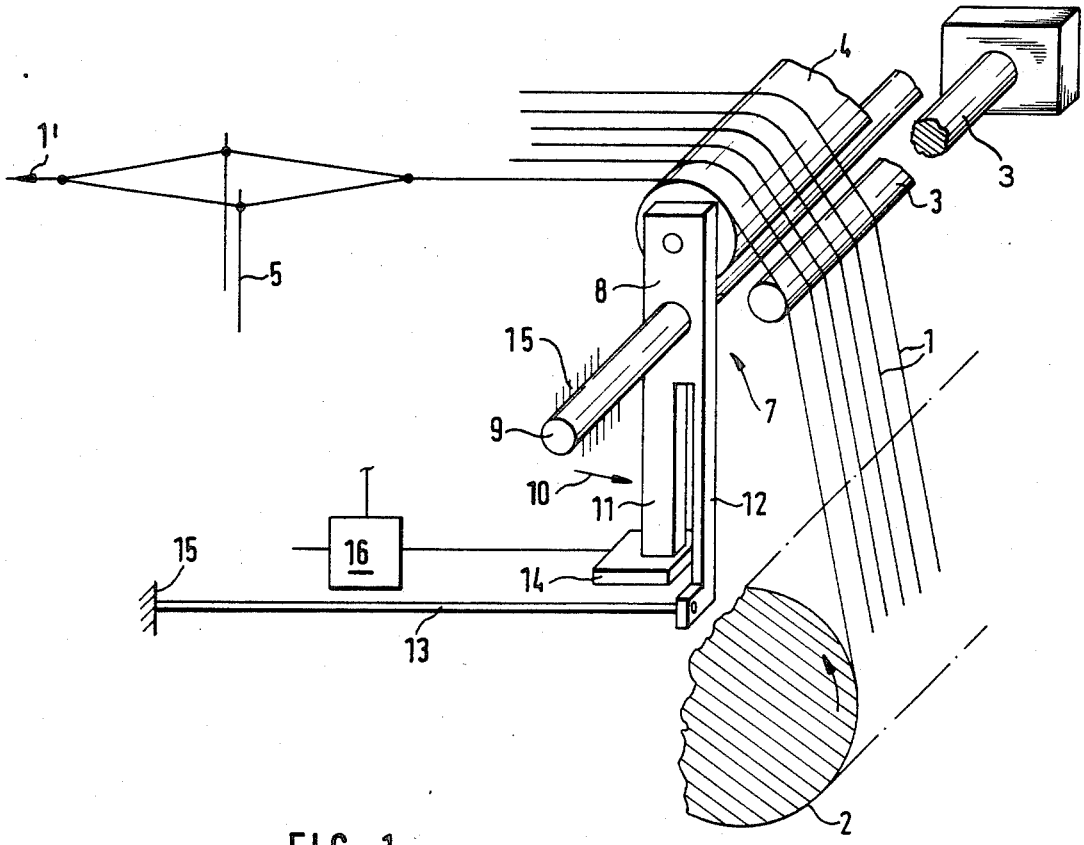
FIG. 1 shows, in a schematic pictorial depiction, a first exemplary embodiment of the inventive back rest arrangement on a weaving machine.

Describing now the drawings, it is to be understood that to simplify the showing thereof, only enough of the structure of the back rest arrangement on a weaving machine has been illustrated therein as is needed to enable one skilled in the art to readily understand the underlying principles and concepts of this invention. Turning now specifically to FIG. 1 of the drawings, there is illustrated therein by way of example and not limitation a first exemplary embodiment of the. invention. A so-called warp or warp sheet 1 is unwound from a warp beam 2 and, via a deflection or guide roll, i.e. a taker-in roll 3 and a so-called back rest 4, is transferred into an essentially horizontal plane in order to arrive at the. shed-forming heddles 5. At this location weft insertion takes. place, whereupon the finished web or woven fabric 1' is wound up on a here not further described cloth beam or take-up roller.

In accordance with the invention, the back rest 4 is carried at one of its ends, but preferably at both of its ends, on an associated arm 8 of a. two-armed support frame or yoke 7. The two-armed support frame or yoke 7 is pivotably supported about a stationary shaft or pivot axis 9 which is mounted on a machine frame 15 in a suitable manner. At least one of the arms 8 of the support frame or yoke 7 possesses a resilient member or shank 12. A free end of the resilient member or shank 12 is supported in a manner which is relatively rigid in relation to the pivoting motion of the support frame or yoke 7 caused by the varying warp force on the back rest 4. In this exemplary embodiment the relatively rigid support is provided by means of a strut or connecting rod 13 which, with its other, free end is appropriately connected with the machine frame 15.

In the exemplary embodiment in accordance with FIG. 1, the abovementioned resilient member or shank 12 is formed by a substantially U-shaped configuration of the related arm 8 of the pivotable support frame or yoke 7. A relatively rigid member or shank 11 is positioned opposite to the resilient member or shank 12 and carries a proximity sensor or probe 14 at its free end. This proximity sensor or probe 14 can be of a capacitive cr inductive construction or a Hall-effect sensor or the like. The proximity sensor or probe 14 cooperates with the resilient shank 12 such that the proximity sensor or probe 14 generates an electrical signal which is proportional to the deflection of the resilient shank 12. The electrical signal is fed to any suitable evaluating circuit 16 in order that it can act in a known manner on the circuitry of a here not particularly shown rotary drive of the warp beam 2 of the weaving machine in order to increase or decrease, as required the let-off of the warp or warp sheet from the warp beam 2.

Figure 2:
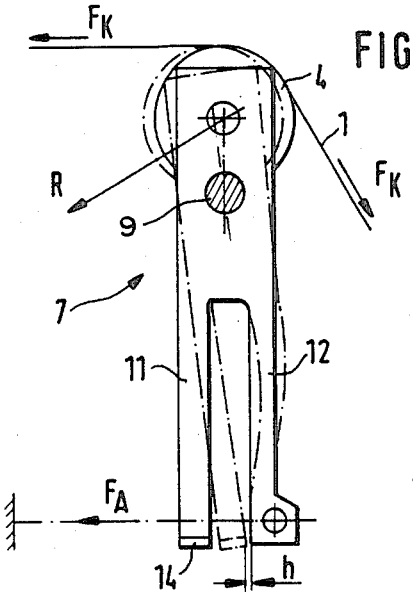
FIG. 2 shows the operative principle of the arrangement in accordance with FIG. 1.

The method of operation is shown in greater detail in the depiction of FIG. 2 in which the support force $F_A$, which is brought to bear directly onto the resilient shank 12 through the strut or connecting rod 13, as shown in FIG. 1, is in equilibrium with the warp force $F_K$ which is operative at the back rest 4. Thus it is achieved that with increasing warp force the resilient shank 12 approaches or comes nearer to the sensing probe 14, while the distance h is a measure of the warp force effective at that moment.

The result of the above is that a very simple concept with a most effective signal triggering is achieved. Furthermore this allows for retrofitting of existing machines and especially also the utilization of the concept in an arrangement with rocking lever or rocker beam mounting of the back rest.

Figure 3:
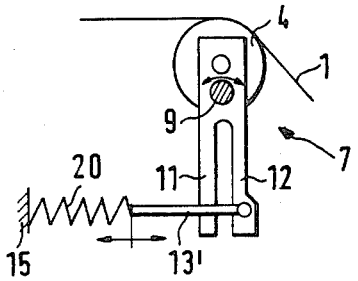
FIGS. 3 and 4 respectively show, in schematic depiction, a second and third exemplary embodiment with respect to the support of the support frame or yoke arrangement in accordance with FIG. 1.
Figure 5:
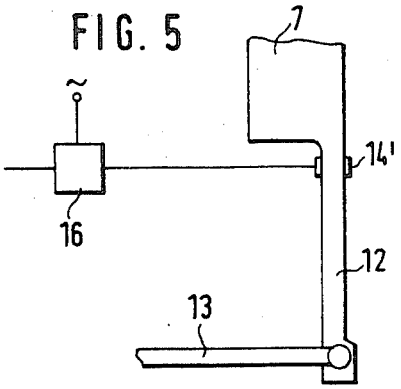
FIG. 5 shows, in schematic depiction, a fourth exemplary embodiment of the support frame or yoke arrangement in accordance with FIG. 1.

For this utilization with an arrangement of rocking levers or rocker beams it is only necessary, in accordance with FIG. 3, that the other free end of a strut or connecting rod 13' be connected to the machine frame 15 by spring means 20 to allow the support frame or yoke 7 to act as a passive rocking lever or rocker beam.

Figure 4:
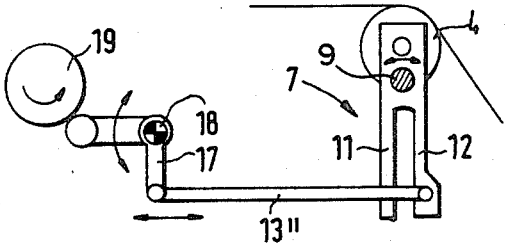

In accordance with FIG. 4 the support frame or yoke 7 can also be constructed as a form-lockingly or positively controlled rocking lever or rocker beam, for which purpose only the other free end of a strut or connecting rod 13'' has to be in operative contact with a swivelling lever or rocking arm mechanism comprising, for instance, a control cam 19, a bell crank or angled rocker arm 17 and a pivot axis 18 of the bell crank.

In the above-described exemplary embodiments the support frame or yoke 7 possesses an arm 8 of U-shaped construction whose one member or shank 12 is resilient and whose other member or shank 11 is relatively, rigid. Thus, in operation, the resilient shank 12 is approached by the stiff or rigid shank 11 and influences a sensing probe 14 arranged at the stiff or rigid shank 11. In a simplified arrangement the support frame or yoke 7 only possesses a single resilient shank 12. This single resilient shank 12 cooperates with an extensometer or strain gauge 14' which directly samples or senses the deflection of the resilient shank 12.

For example the resilient shank 12 can be a leaf spring which is fixedly attached to the body of the support frame or yoke 7.

While there are shown and described present preferred embodiments of the invention, it is to be distinctly understood that the invention is not limited thereto, but may be otherwise variously embodied and practiced within the scope the following claims. ACCORDINGLY,

What we claim is:

1. A back rest arrangement for a weaving machine having a back rest supported in positionally variable manner, comprising;

a machine frame for said weaving machine;

a support yoke possessing a first arm and a second arm and supported on said machine frame;

means cooperating with said machine frame for pivotably supporting said support yoke for pivotal motion about a pivot axis;

said back rest being supported on at least one of said first and second arms of said support yoke;

one of said arms of said support yoke possessing a resilient shank having a free end;

means for retaining said free end of said resilient shank in a manner which is relatively rigid in relation to a pivoting motion of the support yoke caused by a varying warp force acting on said back rest;

a sensor for generating an electrical signal proportional to a deflection of said resilient shank;

said sensor being operatively associated with said resilient shank;

said means for relatively rigidly retaining said free end of said resilient shank comprises a rod;

said rod has a free end; and said free end of said rod being fixedly connected with said machine frame.

2. A back rest arrangement for a weaving machine having a back rest supported in positionally variable manner, comprising;

a machine frame for said weaving machine;

a support yoke possessing a first arm and a second arm and supported on said machine frame;

means cooperating with said machine frame for pivotably supporting said support yoke for pivotal motion about a pivot axis;

said back rest being supported on at least one of said first and second arms of said support yoke;

one of said arms of said support yoke possessing a resilient shank having a free end;

means for retaining said free end of said resilient shank in a manner which is relatively rigid in relation to a pivoting motion of the support yoke caused by a varying warp force acting on said back rest;

a sensor for generating an electrical signal proportional to a deflection of said resilient shank;

said sensor being operatively associated with said resilient shank; and said means for relatively rigidly retaining said free end of said resilient shank comprises a connecting rod.

3. The back rest arrangement as defined in claim 2, further including:

a swivelling lever drive mechanism;

said connecting rod having a free end; and said free end of said connecting rod being operatively connected with said swivelling lever drive mechanism.

4. A back rest arrangement for a weaving machine having a backrest supported in positionally variable manner, comprising;

a machine frame for said weaving machine;

a support yoke possessing a first arm and a second arm and supported on said machine frame;

means cooperating with said machine frame for pivotably supporting said support yoke for pivotal motion about a pivot axis;

said back rest being supported on at least one of said first and second arms of said support yoke;

one of said arms of said support yoke possessing a resilient shank having a free end;

means for retaining said free end of said resilient shank in a manner which is relatively rigid in relation to a pivoting motion of the support yoke casued by a varying warp force acting on said back rest;

a sensor for generating an electrical signal proportional to a deflection of said resilient shank;

said sensor being operatively associated with said resilent shank;

said resilient shank being formed by a substantially U-shaped configuration of one of said arms of said pivotable support yoke;

said one arm possessing a further shank located opposite said resilent shank;

said further shank being rigid and having a free end; and said further shank carrying said sensor at said free end for cooperating with said resilent shank.

5. The back rest arrangement as defined in claim 4, wherein:

said sensor comprises a capacitive proximity probe.

6. The back rest arrangement as defined in claim 4, wherein:

said sensor comprises an inductive proximity probe

7. The back rest arrangement as defined in claim 4, wherein:

said sensor compries a Hall-effect sensor.

* * * * *